US006976308B2

(12) United States Patent
Jonli

(10) Patent No.: US 6,976,308 B2
(45) Date of Patent: Dec. 20, 2005

(54) METHOD FOR CONDUCTIVELY CONNECTING FIRST AND SECOND ELECTRICAL CONDUCTORS

(75) Inventor: Odd Magne Jonli, Ski (NO)

(73) Assignee: NEXANS, Paris (FR)

( * ) Notice: Subject to any disclaimer, the term of this patent is extended or adjusted under 35 U.S.C. 154(b) by 0 days.

(21) Appl. No.: 10/716,184

(22) Filed: Nov. 18, 2003

(65) Prior Publication Data

US 2004/0134062 A1 Jul. 15, 2004

(30) Foreign Application Priority Data

Nov. 29, 2002 (NO) ..... 20025747

(51) Int. Cl.[7] ..... H01R 43/00

(52) U.S. Cl. ..... 29/872; 29/418; 29/611; 29/843; 29/860; 29/875

(58) Field of Search ..... 29/872, 876, 843, 29/860, 875, 611, 418; 174/88; 219/110, 219/56.21, 56.22

(56) References Cited

U.S. PATENT DOCUMENTS 4,032,382 A * 6/1977 Obeda ..... 156/73.2
4,255,613 A * 3/1981 Ketchpel ..... 174/88 R
5,393,950 A * 2/1995 Killian ..... 219/110
5,493,069 A 2/1996 Conti ..... 174/94
5,602,931 A * 2/1997 Geisenberger ..... 381/400
5,945,019 A * 8/1999 Tanaka et al. ..... 219/541
6,072,124 A * 6/2000 Kato et al. ..... 174/84 R

FOREIGN PATENT DOCUMENTS

DE 2934423 A1 3/1981 ..... 11/2

* cited by examiner

*Primary Examiner*—A. Dexter Tugbang
*Assistant Examiner*—Tai Van Nguyen
(74) *Attorney, Agent, or Firm*—Sofer&Haroun, LLP

(57) ABSTRACT

A method for conductively connecting first and second electrical conductors is described which consist of different materials. In carrying out the method the ends of the first and second conductors are brought into mechanical contact with each other in an overlapping position. The first and second conductors then are connected to each other by welding without feeding of additional welding material. Finally the overlapping area is formed mechanically to achieve a smooth width transition between the first and second conductors.

10 Claims, 4 Drawing Sheets

METHOD FOR CONDUCTIVELY CONNECTING FIRST AND SECOND ELECTRICAL CONDUCTORS

RELATED APPLICATION

This application is related to and claims the benefit of priority from Norwegian Patent Application No. 2002 57 47, filed on Nov. 29, 2002, the entirety of which is incorporated herein by reference.

FIELD OF THE INVENTION

The invention is concerned with a method for conductively connecting first and second electrical conductors consisting of different materials.

BACKGROUND OF THE INVENTION

Such a method is used, e.g. for the connection of a smaller resistance conductor of a heating cable and a so called "cold conductor" made of copper for the connection with a power supply. A resistance conductor typically is made of NiCr-alloy. Such a conductor can not be connected to a copper conductor by traditional welding methods. Soldering both conductors causes problems by carbon inclusions in the splicing area with a reduced electrical conductivity. The same problems arise when other electrical conductors of different materials shall be connected.

According to the known method of EP 0 852 245 A2 which is concerned with the connection of a smaller resistance conductor and a larger copper conductor, first the end of the copper conductor is reduced to a smaller diameter. Both conductors then are connected by a crimp connector with a diameter that not exceeds the diameter of the copper conductor. The crimp connector is an additional element. It makes the splicing expensive. The connection has a relative high contact resistance and can cause problems during an extrusion process for applying an insulation sheath to the conductors.

OBJECTS AND SUMMARY OF THE INVENTION

An object of the invention is to provide a method for conductively connecting first and second electrical conductors consisting of different materials and optionally having different diameters, such a method allowing to achieve a good conducting splice and a guidance through an extruder for applying an insulation sheath without disturbances.

Thereby, the invention proposes a method for conductively connecting first and second electrical conductors consisting of different materials characterized in that it comprises the following successive stages:

- the ends of the first and second conductors are brought into mechanical contact with each other in an overlapping position,
- the first and second conductors are connected to each other by welding without feeding of additional welding material and
- the overlapping area is formed mechanically to achieve a smooth width transition between the first and second conductors.

With this method the materials of the conductors are transferred into a weldable condition without additional feeding of a separate welding material. During the welding process the conductors are bonded to each other although they are made of different materials, e.g. different alloys. The method provides mechanical tensile strength in the splicing area and a dimensional smooth width transition between the first conductor and the second conductor.

This makes it possible to process the welded conductors through an extrusion head of an ordinary insulation extrusion line with a guide and a die where the insulation material is applied under significant pressure. A sharp shift between the two conductors, which would meet resistance passing through the pressurised plastic mass in the extrusion head, is avoided.

In addition, the splicing area maintains its ductility. This is good for the manufacturing process, as the joint conductor has to pass through several pulleys.

Advantageously, said method can be used before applying an insulation sheath over said first and second conductors by an extrusion line.

Preferably, the first and second conductors can be connected to each other by ultrasonic welding and preferably using a tool having a serrated base.

The base is serrated in order to better transfer the vibratory force to the conductors. Preferably, the first and second conductors can be connected to each other by ultrasonic welding with the following steps:

- inserting said second conductor on top of said first conductor in said overlapping position between a first lateral moving anvil and a second lateral anvil,
- moving said first anvil to press the sides of said first and/or second conductor,
- pressing a flat top tool against the top of said second conductor,
- using of a transducer causing said flat top tool to vibrate.

Preferably said first conductor can be flatten at one end so as to form at least a flat top surface in which said second conductor is brought into mechanical contact. This step both enhances the mechanical contact and the welding connection.

In one advantageous embodiment of the invention, before bringing into mechanical contact, the circular section of said first conductor is transformed at one end in a section chosen substantially square or rectangular.

In one preferred embodiment of the invention, before bringing into mechanical contact, the circular section of said first conductor is transformed at one end in a section chosen substantially square by the following steps:

- inserting said first conductor between a first lateral moving anvil and a second lateral anvil,
- moving said first anvil to press the sides of said first conductor,
- pressing a flat top toot against the top of said first conductor.

And, after said steps, said method preferably comprises the use of a transducer causing said flat top toot to vibrate, thereby ultrasonic prewelding the first conductor.

Doing this way ensures the least deformation of the second conductor, for instance a harder resistance wire, thereby improving the strength of the splice.

In a first embodiment of the invention, before bringing into mechanical contact, the end of the first conductor is splitted in axial direction into at least two parts which are laid around the end of the second conductor.

In a second embodiment of the invention, before bringing into mechanical contact, the end of the first conductor is formed with a longitudinally extending groove to receive the end of the second conductor.

Said first and second conductors can have different diameters.

The method of the invention can be applied for connecting a resistance conductor for heating cables with a copper conductor.

The method of the invention is described in the following with preferred embodiments in conjunction with the drawings.

DETAILED DESCRIPTION

In the first and second embodiments of the method of the invention is explained with use of ultrasonic welding. Nevertheless other welding methods without feeding of additional welding material, like TIG (Tungsten Inert Gas)-welding, Laser-welding and HF (High Frequency)-welding, also shall be covered.

In addition the method is explained for the connection of a resistance conductor to a copper conductor.

Nevertheless, other conductors with different materials, e.g. alloys, also shall be covered.

Figure 1:
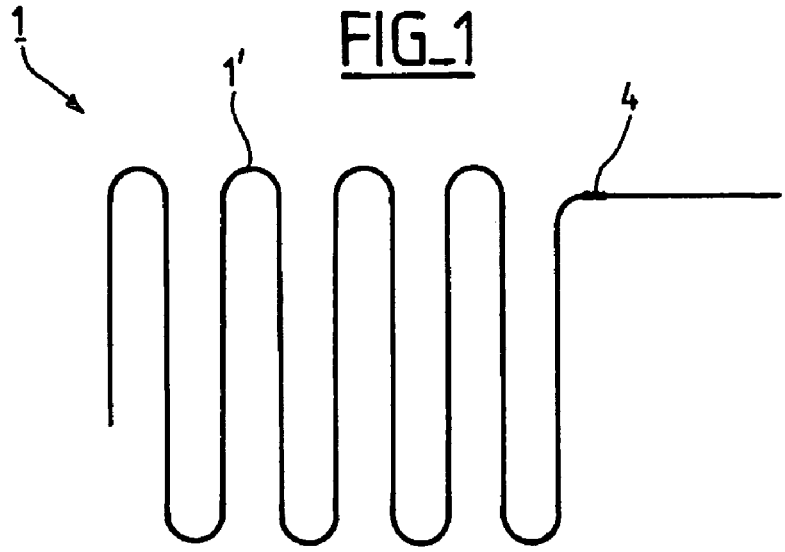
FIG. 1 schematically a heating cable with a connected supply cable.

FIG. 1 schematically shows a heating cable 1 which is mounted in the floor of a building (not shown) meander-shaped. The heating cable 1 comprises a resistance conductor and a copper conductor (not visible) which are connected to each other in a splicing area 4.

The conductors are enclosed into a sheath 1' of insulating material which can be applied by an extrusion line (not shown). Only by way of example, the resistance conductor has a smaller diameter than the copper conductor. A copper conductor can also be in some cases smaller than the largest resistance wire. Both conductors are connected to each other in the splicing area 4 using the method of the invention in her first or second embodiment.

Figure 2:
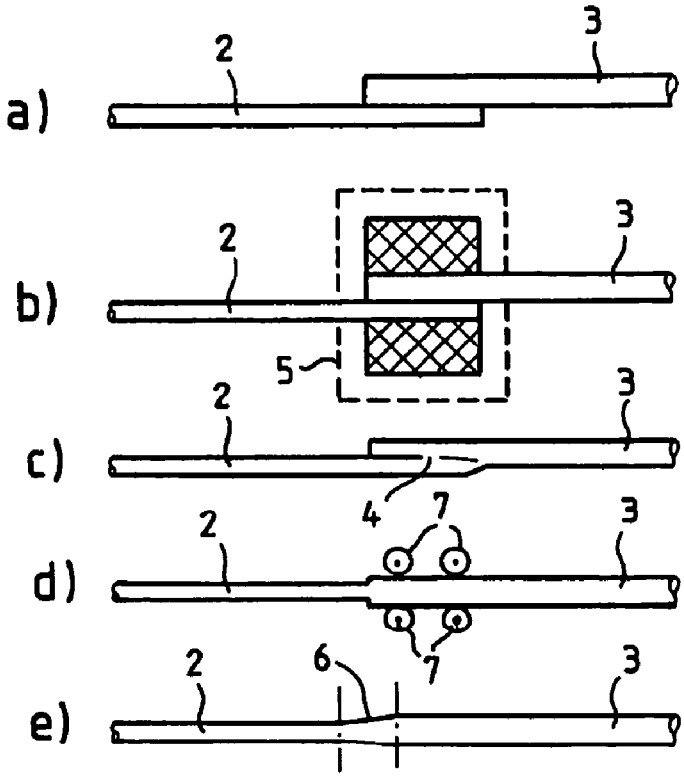
FIG. 2 five stages of a method for conductively connecting two electrical conductors, in a first embodiment of the invention.

In the first embodiment of the method of the invention, the two conductors 2, 3 are brought into mechanical contact with each other in an overlapping position, according to FIG. 2*a*. In this position they are placed in an ultrasonic welding machine 5 and welded to each other, according to FIG. 2*b*. The ultrasonic welding takes place by vibration for instance at 20 kHz longitudinally, thus preferably using high vibratory energy with low amplitudes on the movement. The two conductors 2, 3 move against each other in a way that removes oxide layers and create an intermolecular bond.

Thus, the materials of the two conductors 2 and 3 are made weldable by ultrasonic energy and therefrom are bonded to each other without additional welding material in a connection with high mechanical tensile strength. The connected conductors 2 and 3 with their splicing area 4 are shown in FIG. 2*c*.

The splicing area 4 now is formed mechanically to achieve a smooth diameter transition 6 between the two conductors 2 and 3 as shown in FIG. 2*e*. The mechanical deformation is indicated in FIG. 2*d* by four rollers 7. It can be done e.g. by milling, rolling or forging.

Figure 3:
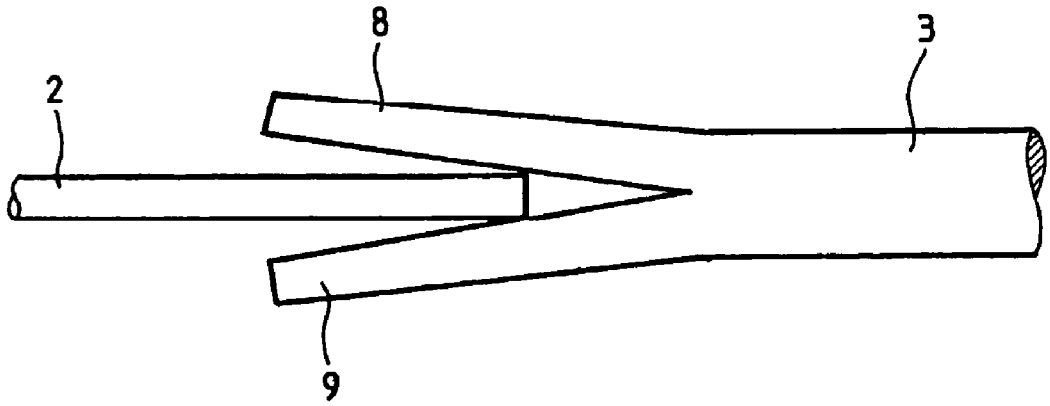
FIGS. 3 and 4 details of conductors to be connected according the invention in enlarged scales.
Figure 4:
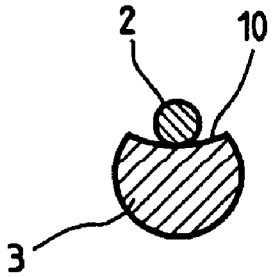

Prior to welding of the two conductors 2 and 3, and, more precisely, prior to bring them into mechanical contact, it is possible to prepare the end of the copper conductor 3 according to FIGS. 3 and 4.

So it is possible to split the end of the copper conductor 3 in axial direction into at least two parts 8 and 9 between which the resistance conductor 2 can be inserted. It also is possible to form a longitudinally extending groove 10 into the end of the copper conductor 3, into which the resistance conductor 2 can be laid.

Figure 5:
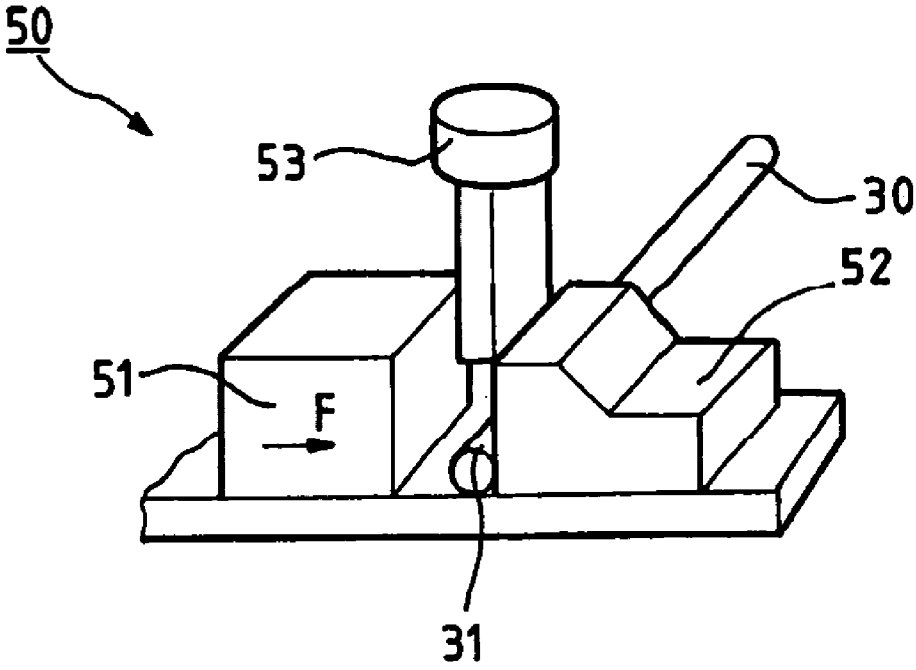
FIG. 5 schematically a first stage of a method for conductively connecting two electrical conductors in a second embodiment of the invention.

In the second embodiment of the method of the invention, the end of the copper conductor 30 is prepared in a first stage, according to FIG. 5.

The circular section of the copper conductor 30 is to be transformed at one end 31 in a section substantially square, preferably with the help of an ultrasonic welding machine 50 comprising a first lateral moving anvil 51, a second fixed lateral anvil 52 and a flat top tool 53 having a serrated base (surface not visible). The square shape makes it easier to place the resistance conductor on the top if it.

This first stage comprises the following steps:

- inserting the copper conductor 30 between the first lateral moving anvil 51 and the second lateral anvil 52,
- moving the first anvil 51 (see arrow F) to press the sides of the copper conductor 30,
- lowering and pressing the flat top tool 53 against the top of the copper conductor 30 at a predetermined pressure,
- and preferably using a transducer (not shown) of the welding machine 50 causing the top tool 53 to vibrate, thereby ultrasonic prewelding the copper conductor 30.

Then, the anvil 51 jaws open and the tip 53 returns to a rest position.

Figure 6:
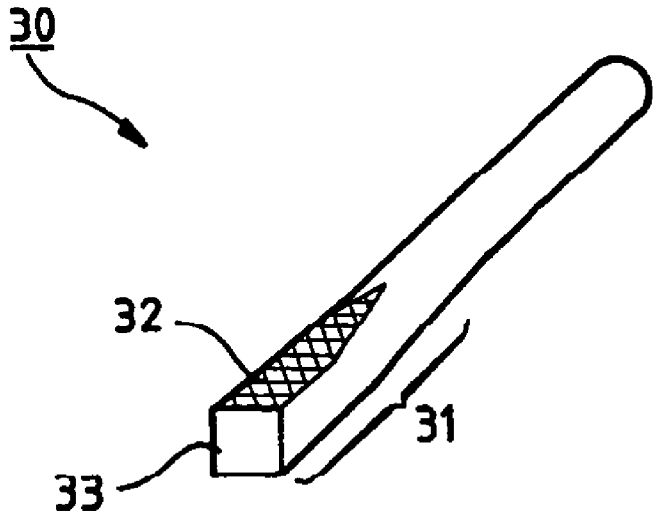
FIG. 6 schematically one of the electrical conductors after processing the first stage.

FIG. 6 shows schematically the copper conductor 30 after said first stage. At the prepared end 31, the circular section of the copper conductor 30 is transformed in a section 33 substantially square. The flat top surface 32 of the copper conductor 30 is suitable to receive the resistance conductor. The flat top surface 32 of the copper conductor 30 is serrated (as symbolized in FIG. 6).

Figure 7:
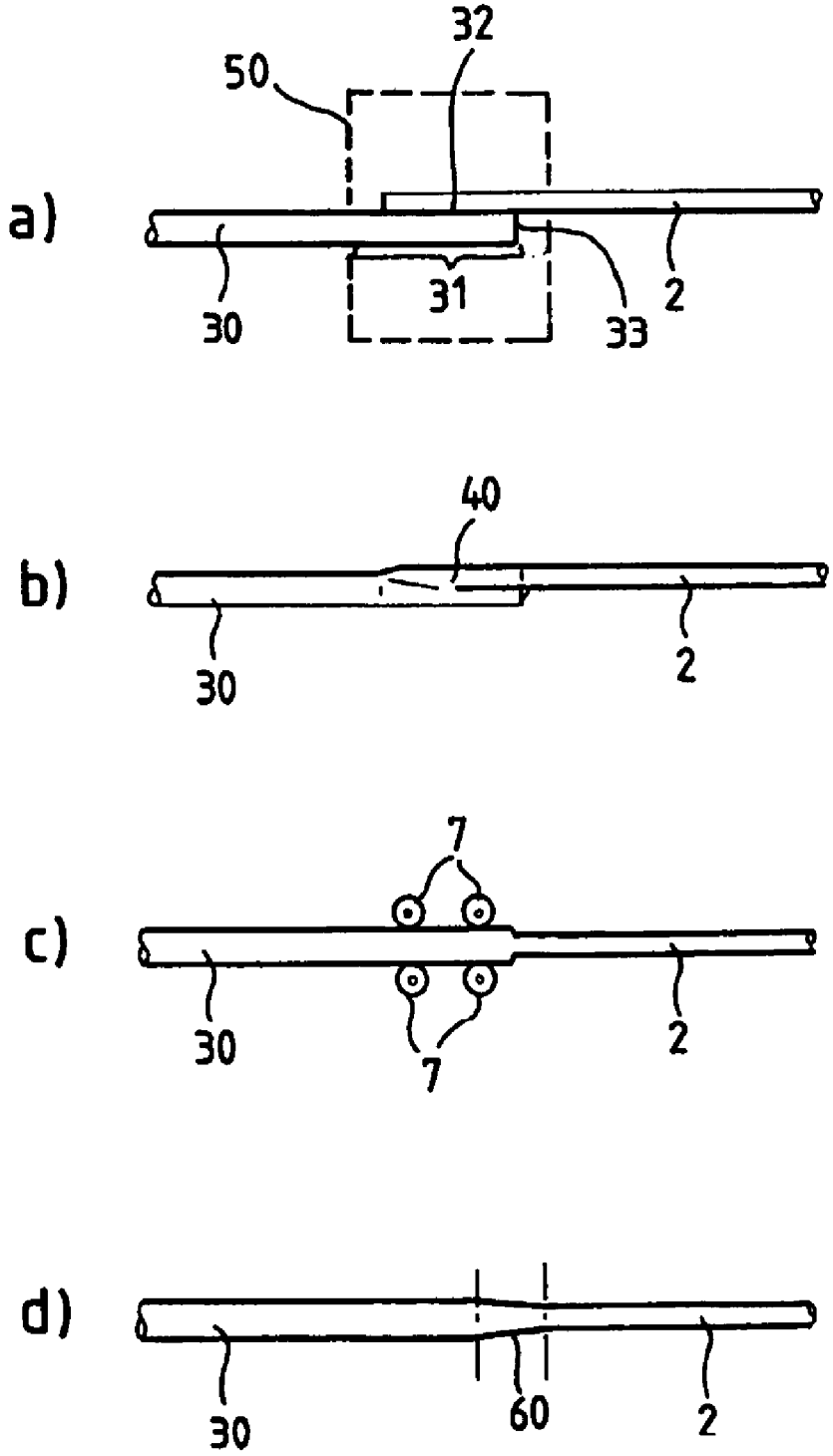
FIG. 7 schematically four additional successive stages in said second embodiment of the invention.

Within the welding machine 50 and, more precisely, between the first lateral moving anvil and the second lateral anvil, the resistance conductor 2 is brought into mechanical contact with the flat top surface 32 of the copper conductor 30 with the square shape 33, in an overlapping position, according to FIG. 7*a*.

In this position the two conductors 2, 30 are welded to each other by ultrasonic welding. The first anvil moves to press the sides of the copper and/or resistance conductor. The flat top tool presses against the top of the resistance conductor. The transducer causes the top tool to vibrate. The ultrasonic welding takes place when the top tool is vibrating for instance at 20 kHz longitudinally, preferably using high vibratory energy with low amplitudes on the movement. The two conductors 2, 30 move against each other in a way that removes oxide layers and create an intermolecular bond.

Thus, the materials of the two conductors 2 and 30 are made weldable by ultrasonic energy and therefrom are bonded to each other without additional welding material in a connection with high mechanical tensile strength.

The connected conductors 2 and 30 with their splicing area 40 are shown in FIG. 7*b*. The splicing area 40 now is formed mechanically to achieve a smooth width transition 60 between the two conductors 2 and 30 as shown in FIG.

7*d*. The mechanical deformation is indicated in FIG. 7*c* by four rollers 7. It can be done e.g. by milling, rotting or forging.

Both conductors 2, 3, 30 are single-wire conductors as described above and shown in the drawings. They also can be—one of them or both—multiwire conductors. Resistance conductor 2 e.g. may be a three-wire conductor connected with a single-wire copper conductor 3, 30 or a seven-wire copper conductor. Other numbers of wires in the multiwire conductors also are possible.

What is claimed is:

1. A method for conductively connecting first and second electrical conductors, said method comprising the steps of:

bringing ends of the first and second conductors into mechanical contact with each other in an overlapping position, said first and second conductors being composed of different materials, connecting said first and second conductors to each other by welding without feeding of additional welding material;

mechanically forming the overlapping area to achieve a smooth width transition between said first and second conductors; and applying an insulation sheath over said first and second conductors by an extrusion line.

2. A method according to claim 1, wherein the first and second conductors are connected to each other by ultrasonic welding and preferably using a tool having a serrated base.

3. A method according to claim 1, wherein the first and second conductors are connected to each other by ultrasonic welding, further comprising the steps of:

inserting said second conductor on top of said first conductor in said overlapping position between a first lateral moving anvil and a second lateral anvil, moving said first anvil to press the sides of said first and/or second conductor, pressing a flat top tool against the top of said second conductor, using of a transducer causing said flat top tool to vibrate.

4. A method according to claim 1, wherein said first conductor is flattened at one end so as to form at least a flat top surface in which said second conductor is brought into mechanical contact.

5. A method according to claim 1, wherein, before bringing into mechanical contact, the circular section of said first conductor is transformed at one end in a section chosen substantially square or rectangular.

6. A method according to claim 1, wherein before bringing into mechanical contact, the circular section of said first conductor is transformed at one end in a section chosen substantially square, further comprising the steps of:

inserting said first conductor between a first lateral moving anvil and a second lateral anvil, moving said first anvil to press the sides of said first conductor, pressing a flat top tool against the top of said first conductor, such that, after said steps, said method uses a transducer causing said flat top tool to vibrate, thereby ultrasonic prewelding the first conductor.

7. A method according to claim 1, wherein, before bringing into mechanical contact, the end of the first conductor is split in an axial direction into at least two parts which are laid around the end of the second conductor.

8. A method according to claim 1, wherein, before bringing into mechanical contact, the end of the first conductor is formed with a longitudinally extending groove to receive the end of the second conductor.

9. A method according to claim 1, wherein said first and second conductors have different diameters.

10. A method according to claim 1, wherein it is applied for connecting a resistance conductor for heating cables with a copper conductor.

* * * * *